US007252082B2

(12) United States Patent
Bartmann et al.

(10) Patent No.: US 7,252,082 B2
(45) Date of Patent: Aug. 7, 2007

(54) HOUSEHOLD APPLIANCE

(75) Inventors: Frank Bartmann, Hambrücken (DE); Jochen Herbolsheimer, Trostberg (DE); Horst Krenz, Bretten-Ruit (DE); Heiko Meyer, Walzbachtal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 83 days.

(21) Appl. No.: 10/928,213

(22) Filed: Aug. 27, 2004

(65) Prior Publication Data

US 2005/0023945 A1 Feb. 3, 2005

Related U.S. Application Data

(63) Continuation of application No. PCT/EP03/01503, filed on Feb. 14, 2003.

(30) Foreign Application Priority Data

Feb. 27, 2002 (DE) ..... 102 08 490

(51) Int. Cl.
*F24C 15/02* (2006.01)
*A47B 88/12* (2006.01)

(52) U.S. Cl. ..... 126/191; 126/194; 126/273 R; 312/319.2; 312/323

(58) Field of Classification Search ..... 126/190, 126/191, 197, 192, 194, 198, 19 R, 273 R; 312/323, 326, 319, 334.1, 109, 319.2, 322
See application file for complete search history.

(56) References Cited

U.S. PATENT DOCUMENTS

| | | | | |
|---|---|---|---|---|
| 1,873,522 | A * | 8/1932 | Abbott et al. | 312/321 |
| 2,925,081 | A | 2/1960 | Shooter | |
| 3,127,889 | A | 4/1964 | Mills | |
| 3,955,865 | A * | 5/1976 | Wilson | 126/191 |
| 4,375,907 | A | 3/1983 | Vander Kooi et al. | |
| 4,726,352 | A | 2/1988 | Radke | |
| 4,817,240 | A * | 4/1989 | Sovis et al. | 126/194 |
| 4,995,143 | A | 2/1991 | Demura et al. | |
| 6,397,836 | B1 | 6/2002 | Pelletier et al. | |

FOREIGN PATENT DOCUMENTS

| | | | |
|---|---|---|---|
| DE | 1 800 425 | | 11/1959 |
| DE | 1 274 306 | | 8/1961 |
| DE | 199 06 913 | A1 | 8/2000 |
| FR | 1.299.303 | | 6/1962 |
| FR | 2 269 888 | A * | 12/1975 |
| GB | 1072562 | A * | 6/1967 |
| WO | 02/059528 | A1 | 8/2002 |

* cited by examiner

*Primary Examiner*—Josiah C. Cocks
(74) *Attorney, Agent, or Firm*—Russell W. Warnock; Craig J. Loest

(57) ABSTRACT

A household appliance has a useful storage volume that can be closed by a door pivotally mounted around a horizontal articulation axis and also has a storage compartment. The door can be displaced in the storage compartment by a guiding system including at least one guiding element associated with the door, the guiding element being guided in a slide track associated with the appliance. To produce an ergonomically economical opening and closing movement of the door, the door is provided with at least one counter-weight configuration that, during displacement of the door, exerts a balancing force on the door acting against the weight of the door.

19 Claims, 12 Drawing Sheets

HOUSEHOLD APPLIANCE

CROSS-REFERENCE TO RELATED APPLICATION

This application is a continuation, under 35 U.S.C. § 120, of copending international application No. PCT/EP03/01503, filed Feb. 14, 2003, which designated the United States; this application also claims the priority, under 35 U.S.C. § 119, of German patent application No. 102 08 490.4, filed Feb. 27, 2002; the prior applications are herewith incorporated by reference in their entirety.

BACKGROUND OF THE INVENTION

Field of the Invention

The present invention relates to a household appliance having a useful space, which can be closed by a door mounted pivotally about a horizontal hinge pin, and a storage space, in which the door can be displaced by a guide system which has at least one guide element which is assigned to the door and is guided in a slotted-guide track assigned to the household appliance.

German Published, Non-Prosecuted Patent Application DE 199 06 913 discloses a generic household appliance having a door that closes a useful space in the household appliance. Below the useful space, an opening having a guide system disposed in it is formed in a horizontal plane. The door can be slid into the opening through the guide system.

SUMMARY OF THE INVENTION

It is accordingly an object of the invention to provide a household appliance that overcomes the hereinafore-mentioned disadvantages of the heretofore-known devices of this general type and that has a door that permits an opening and closing movement of the door that is ergonomically favorable for an operator.

With the foregoing and other objects in view, there is provided, in accordance with the invention, a household appliance, including a housing defining a useful space, a door opening, and a storage space, a horizontal hinge pin connected to the housing, a slotted-guide track connected to the housing, a door pivotally mounted about the hinge pin to pivot with respect to the housing and, thereby, selectively close off the door opening and the space, a guide system having at least one guide element connected to the door, the guide system displacing the door into the storage space, and at least one weight-balancing configuration operatively connected to the door and, during a movement of the door, exerting a balancing force on the door, the balancing force acting counter to a weight of the door.

With the objects of the invention in view, in a household appliance having a housing defining a useful space, a door opening, and a storage space, there is also provided a door assembly including a horizontal hinge pin connected to the housing, a slotted-guide track connected to the housing, a door pivotally mounted about the hinge pin to pivot with respect to the housing and, thereby, selectively close off the door opening and the space, a guide system having at least one guide element connected to the door, the guide system displacing the door into the storage space, and at least one weight-balancing configuration operatively connected to the door and, during a movement of the door, exerting a balancing force on the door, the balancing force acting counter to a weight of the door.

The door is associated with at least one weight-balancing configuration. During a movement of the door, the weight-balancing configuration exerts a balancing force on the door, which force acts counter to the weight of the door. The effect that is achieved by this is that the weight of the door is not absorbed by an operator during the movement of the door, but, rather, the operator is relieved of the weight of the door.

Because the weight of the door is compensated for by the weight-balancing configuration, a driving force for opening and closing the door is reduced advantageously. In the case of a motor-powered drive of the door, a cost-effective driving motor with lower power can, therefore, be used. Analogously, in the case of manual actuation of the door, the driving force for opening or closing the door, which force is to be exerted by the operator on the door, is reduced. As a result, an ergonomically more favorable actuation of the door arises.

In accordance with another feature of the invention, the weight-balancing configuration is in engagement with the door exclusively during a pivoting movement of the door while it is disengaged from the door during a horizontal movement of the door. In the case of the horizontal movement of the door, the weight of the door is absorbed by the guide system. As a result, an extremely smooth-running horizontal movement of the door is obtained.

In accordance with a further feature of the invention, to exert the balancing force, the weight-balancing configuration can interact directly with the guide element of the door. As a result, the movement of a guide element guided in a slotted-guide track can be directly influenced to exert the balancing force on the door. Thus, for example, in selected track sections of the slotted-guide track, a frictional force between the slotted-guide track and the guide element that can be displaced therein can be increased. The increased frictional force acts as a balancing force on the door.

In accordance with an added feature of the invention, in a particularly cost-effective and effective variant, the weight-balancing configuration can have a spring that exerts a spring force as balancing force on the door or the guide element.

In accordance with an additional feature of the invention, advantageously, the spring can interact with a pivoting lever by which the spring force is exerted on the guide element. This makes it possible, firstly, for a balancing moment to be exerted on the guide element through an appropriately selected lever arm length of the pivoting lever. Secondly, it is possible, by a suitable pivoting radius of the pivoting lever, for the pivoting lever to be in engagement with the guide element of the door only in certain track sections of the slotted-guide track. It can, thus, be advantageous for a smooth-running movement of the door, for example, in a horizontal track section of the slotted-guide track, if the pivoting lever is disengaged from the guide element.

In accordance with yet another feature of the invention, the guide element runs in a special starting section of the slotted-guide track during a pivoting movement of the door out of its closed position; the pivoting movement of the door takes place during a movement of the guide element within this starting section. To compensate for the weight of the door during this pivoting movement, the weight-balancing configuration is in engagement with the door in the region of the starting section.

In accordance with yet a further feature of the invention, if the door is disposed vertically in a closed position and can be pivoted downward or upward into an open position, it may be advantageous for the door, at the beginning of the opening movement from the closed position, to initially be disengaged from the weight-balancing configuration. As a result, an initial movement of the door out of its closed position is simplified for the operator. Preferably, the weight-balancing configuration enters into engagement with the door in the direction of the open position about a pivoting angle of 20° after the vertical closed position.

In this above-described case, the pivoting lever acts as a stop that is pre-stressed by the spring and signals to the operator a certain pivoting position of the door. As a result, the operator can rapidly and reliably move the door into this certain pivoting position. So that the door is retained stably in this certain pivoting position, which will seem sensible to the expert, the slotted-guide track can be associated with an additional holding element. To stably retain the door in this pivoting position, the holding element presses the guide element of the door in the direction of the pivoting lever.

Within this abovementioned pivoting angle region of the door, the pivoting lever is disengaged from the guide element. In such a case, the pivoting lever can be pressed against a first end stop by the spring.

In accordance with yet an added feature of the invention, it is advantageous for an ergonomically favorable and harmonic movement of the door if the starting section of the slotted-guide track merges into a slide-in section in which the door can be displaced within a substantially horizontal plane. So that a smooth-running horizontal movement of the door is possible during a movement of the guide element in the region of this slide-in section of the slotted-guide track, the pivoting lever can be disengaged from the guide element in the region of the slide-in section.

In accordance with yet an additional feature of the invention, to ensure that the pivoting lever remains reliably disengaged from the guide element during the movement of the guide element in the slide-in section of the slotted-guide track, the pivoting lever is pressed in this region against a second end stop by the spring.

In accordance with a concomitant feature of the invention, it is, furthermore, advantageous if the pivoting lever has a driver. During the displacement of the door from the slide-in section into the starting section of the slotted-guide track, the driver comes into engagement with the guide element, and can, thereby, bring the pivoting lever automatically again into an operative connection with the guide element.

Other features that are considered as characteristic for the invention are set forth in the appended claims.

Although the invention is illustrated and described herein as embodied in a household appliance, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
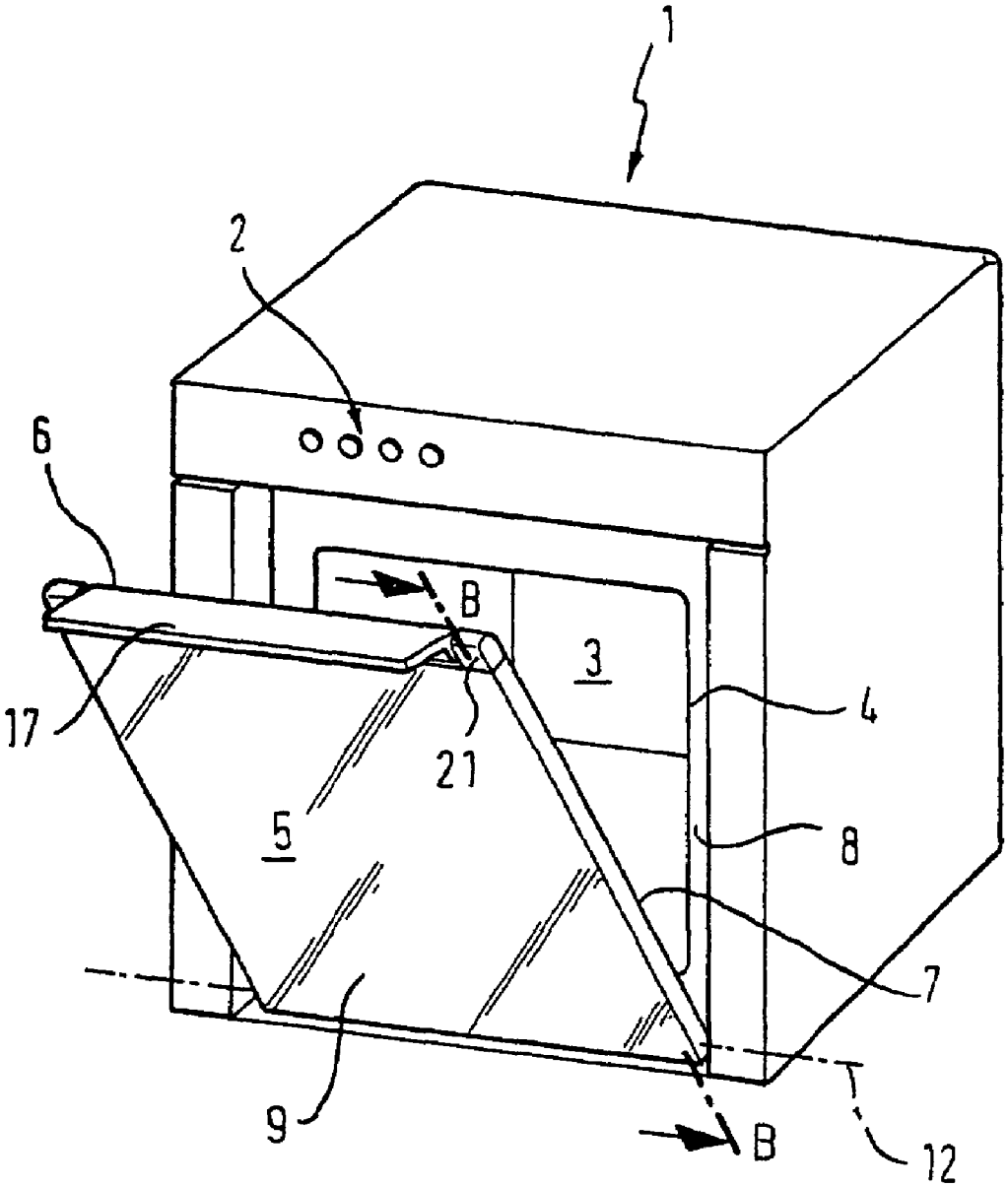
FIG. 1 is a perspective front view of a first exemplary embodiment of a cooking appliance according to the invention with an opened door.

Referring now to the figures of the drawings in detail and first, particularly to FIG. 1 thereof, there is shown a cooking appliance 1 in a first exemplary embodiment of a household appliance according to the invention. The cooking appliance 1 has front-side operating and display elements 2 with an associated non-illustrated control unit. Furthermore, a cooking space 3 is provided in the cooking appliance 1. The cooking space 3 is bounded by a muffle 4 that is open on the front side. A front-side muffle frame 8 frames the front-side opening of the muffle 4. The cooking space 3 can be closed by a door 5 that is mounted pivotally about a horizontal hinge pin or articulation axis 12. The door 5 has an inner door window 7 and an outer door window 9 of glass or glass ceramic. A door handle 17, which is mounted pivotally in a bearing housing 21, is provided on an upper end side 6 of the door 5.

Figure 2:
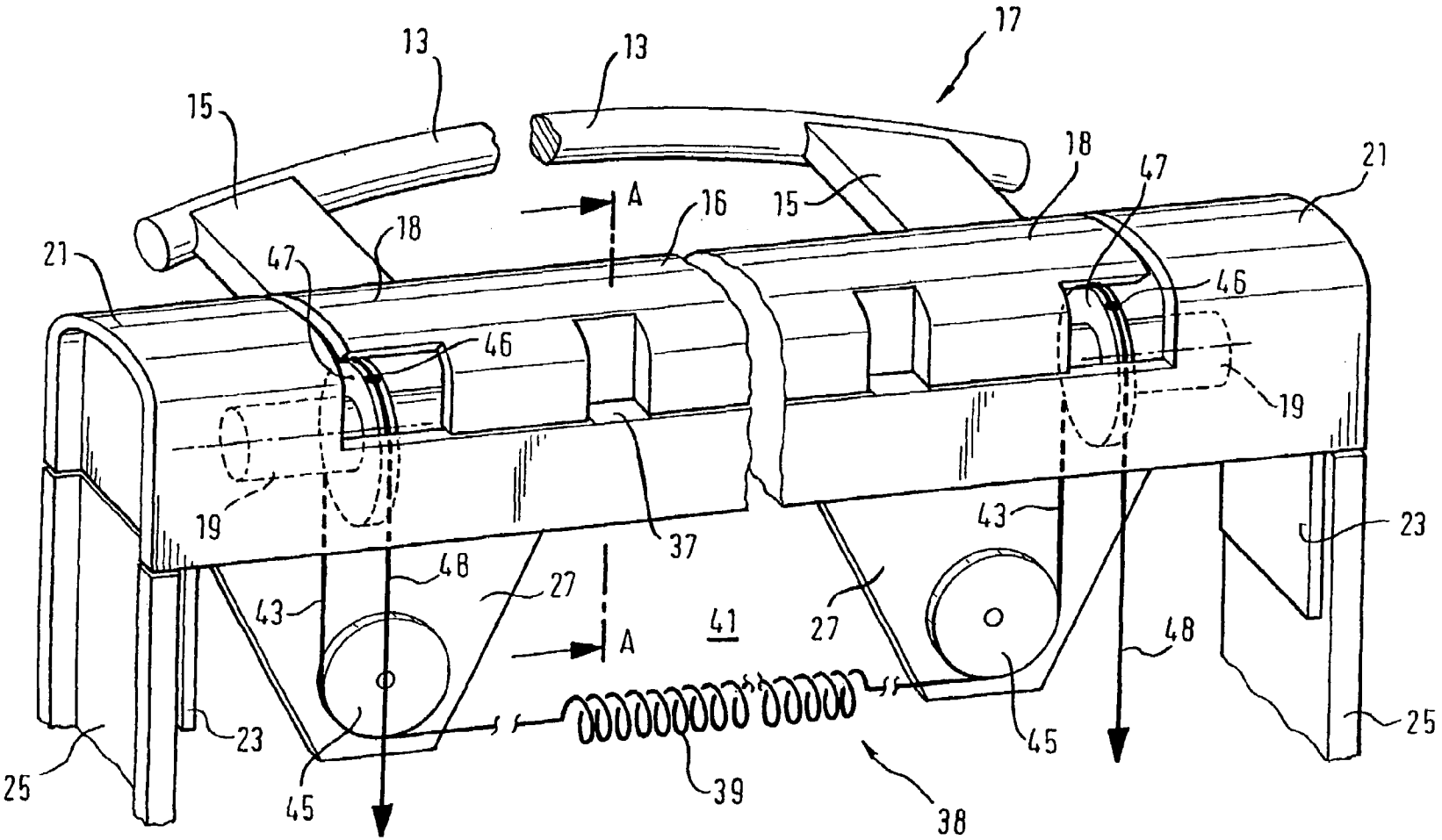
FIG. 2 is a fragmentary, enlarged perspective and partially hidden view of a cutout of a door handle according to the invention with an associated bearing housing.

FIG. 2 shows the configuration including the door handle 17 and the bearing housing 21 in a perspective illustration enlarged in some sections. For simplification purposes, the inner and outer door windows 7, 9 of the door are omitted. The door handle 17 has a handle strip 13 that is connected to a pivoting part 16 through bearing blocks 15. The pivoting part 16 forms the upper end side 6 of the door 5 and has pivot pins 19 on both sides in the longitudinal direction. The pivot pins 19 are mounted rotatably in the bearing housing 21. Both the bearing housing 21 and the pivoting part 16 are, preferably, manufactured as an injection molded part from a duroplastic (thermosetting plastic material). Stiffening elements 23 are formed on both longitudinal sides of the bearing housing 21. These stiffening elements 23 dip into an inner space 41 of the door and are fastened releasably, for example, screwed, to lateral edge strips 25 of the door 5.

Figure 3:
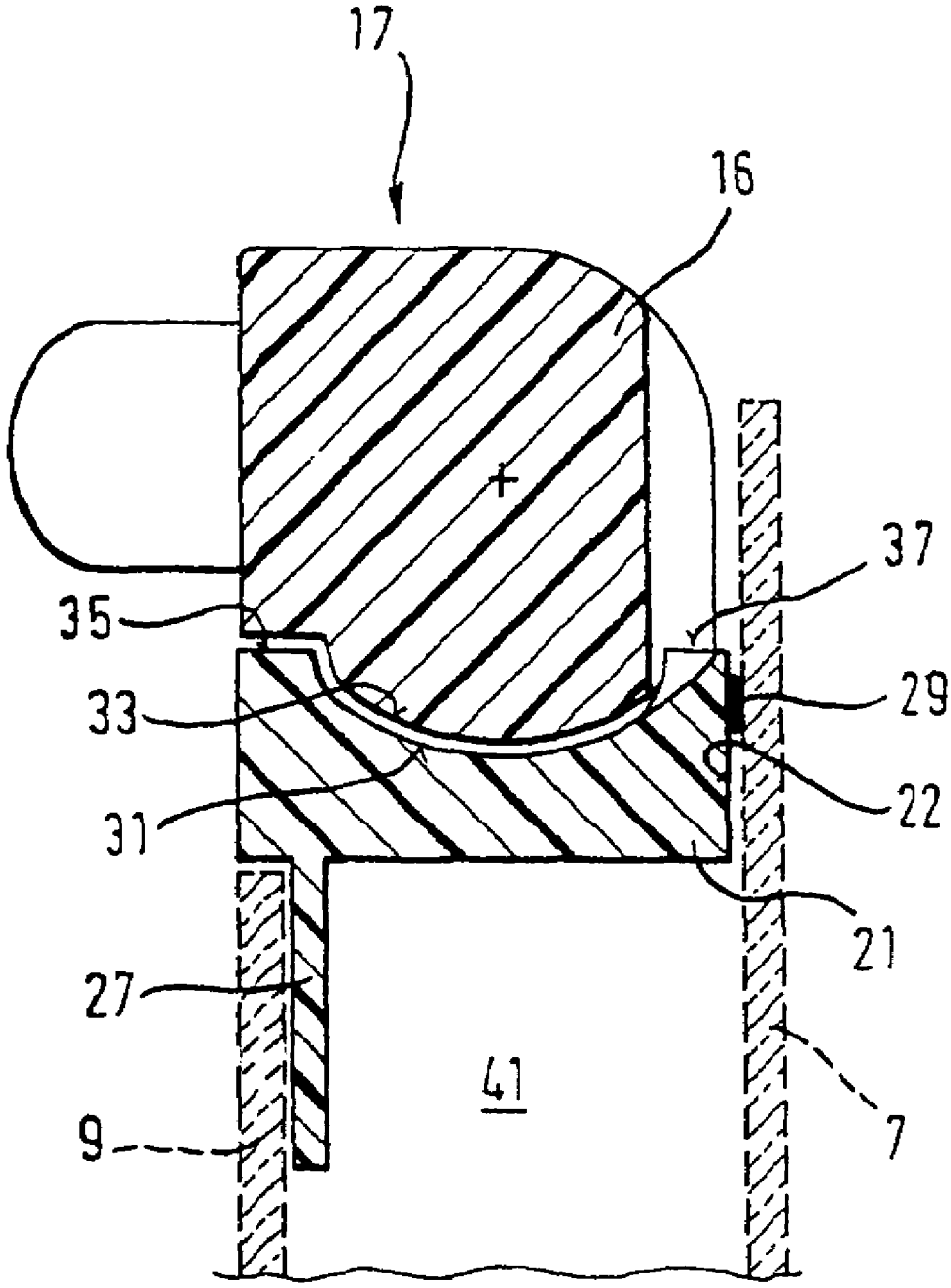
FIG. 3 is a fragmentary, side cross-sectional view of the handle of FIG. 2 along section line A-A.

Additional stiffening elements 27 are formed on the front side of the bearing housing 21. According to FIG. 3, the stiffening elements 27 are in contact with the outer door window 9. FIG. 3 shows a sectional illustration along the line A-A from FIG. 2, in which the door windows 7, 9 are indicated in dashed lines. Accordingly, the stiffening element 27 is in contact with the outer door window 9 while the inner door window 7 rests, with the interposition of a seal 29, against a contact surface 22 of the bearing housing 21. FIG. 3, furthermore, reveals that the bearing housing 21 has a supporting surface 31. The supporting surface 31 is disposed between the lateral pivot pins 19 and extends in the axial direction of the pivoting part 16 over virtually the entire length of the pivoting part 1. A corresponding mating surface 33 of the pivoting part 16 is in contact with the supporting surface 31. During the pivoting movement of the door handle 17, the pivoting part 16 thereof is, therefore, supported on the supporting surface 31. Furthermore, two stops 35, 37 that restrict and bound a pivoting region of the door handle 17 are formed on the bearing housing 21.

As illustrated in FIG. 2, the door handle 17 is assigned a tension spring 39 that pre-stresses the door handle 17 in a pivoting direction. The tension spring 39 is provided below the bearing housing 21 and extends in the longitudinal direction of the bearing housing 21. The tension spring 39 is suspended freely in the inner space 41 of the door that is formed between the door windows 7, 9. The freely suspended configuration of the tension spring 39 within the inner space 41 of the door makes it possible to achieve a free expansion and, therefore, low-wear loading of the tension spring 39.

The two ends of the tension spring 39 are connected in each case through a first tension cable 43 to the pivoting part 16 to transmit a tension spring force to the pivoting part 16. The first tension cables 43 are guided through deflecting rollers 45, which are mounted rotatably on the stiffening elements 27, to radial cam plates 47. The radial cams 47 are connected on both sides in a rotationally fixed manner to the longitudinal ends of the pivoting part 16. Each of the first pulling cables 43 here is fixed on the circumference of the cam plate 47 at a fastening point 46. As a result, the tension spring 39 pre-stresses the door handle 17 against the first stop 35 and subjects the door handle 17 to a first torque M1 in a pivoting direction. To protect against contamination, the radial cams 47 are disposed within lateral cutouts of the pivoting part 16. Covering sections 18 of the pivoting part 16 cover the cutouts on the end side.

A second tension cable 48 engages on the circumference of each of the radial cams 47. The second tension cable 48 is guided around the cam plate 47 in the direction counter to the first pulling cable 43 and is fixed on the circumference of the cam plate 47 at the fastening point 46. The first and second tension cables 43, 48 and the radial cams 47 form constituent parts of a control mechanism 38. The control mechanism 38 transmits a pivoting movement of the door 5 to the door handle 17, i.e., when the door 5 is pivoted in a first pivoting direction, the control mechanism 38 pivots the door handle 17 in a second pivoting direction, counter to the first pivoting direction. The construction and functioning of the control mechanism 38 are explained below with reference to FIG. 4.

Figure 4:
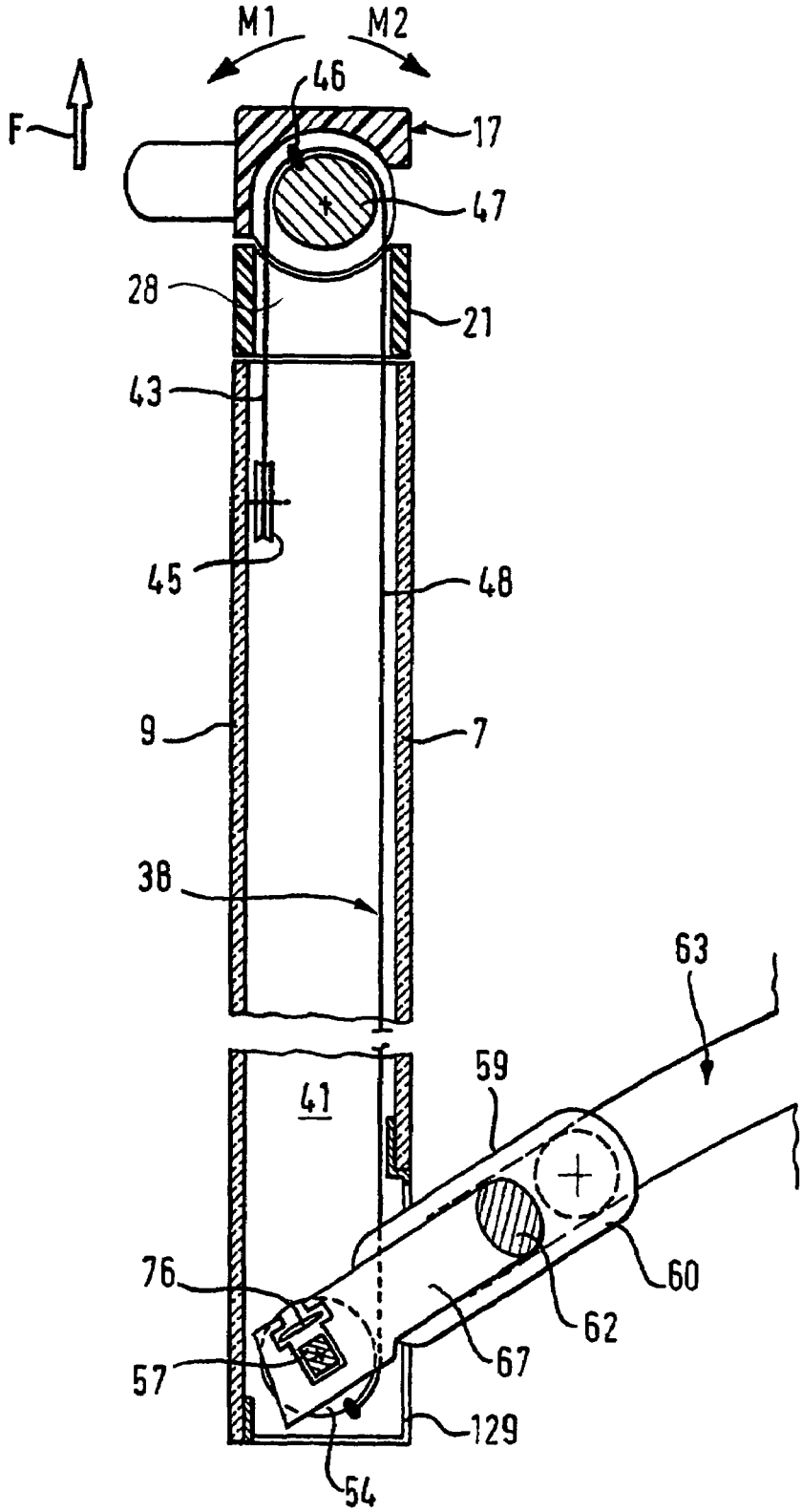
FIG. 4 is a fragmentary, side cross-sectional view of the door handle of FIG. 1 along section line B-B.

FIG. 4 shows an upper and lower cutout of the door 5 in a sectional illustration along the line B-B from FIG. 1. The door 5 is disposed in a closed position. A driving drum 54 that serves as a driving part of the control mechanism is disposed in the lower section of the door 5. Starting from the driving drum 54, a rotational movement is transmitted through the tension cable 48 to the radial cam 47. The tension cable 48 engages on the circumference of the radial cam 47. The tension cable 48, therefore, converts the rotational movement of the driving drum 54 into a rotational movement of the radial cam 47.

If the door 5 is pivoted downward from its closed position, which is shown in FIG. 4, the driving drum 54 rotates. The introduction of movement into the driving drum 54 is described later on with reference to the second exemplary embodiment. The rotational movement of the driving drum 54 is transmitted through the tension cable 48 to the radial cam 47. As a result, a second torque M2, which is directed counter to the first torque M1, is exerted on the door handle 17. The effect that can be achieved as a result is that the horizontal alignment of the door handle 17 that is shown in FIG. 4 is substantially retained regardless of the pivoting position of the door 5.

If an operator exerts an upwardly directed actuating force F on the door handle 17 shown in FIG. 4—for example, during transportation of the cooking appliance—the resultant pivoting movement of the pivoting part 16 of the door handle in the clockwise direction is absorbed by the tension spring 39. This prevents the pivoting movement of the door handle 17, which movement is directed in the clockwise direction of FIG. 4, from being transmitted to the control mechanism 38. The tension spring 39, accordingly, acts, as a safeguarding device that prevents damage to the control mechanism 38.

The magnitude of the spring force of the tension spring 39 and/or the torque M1 exerted thereby is based on a minimum value for the spring force of the tension spring 39. This minimum value corresponds approximately to the frictional forces that have to be overcome to restore the door handle 17 after an actuating force F is no longer exerted on the door handle 17. The tension spring 39 is dimensioned such that the abovementioned minimum value is approximately 10% to 20% of the spring force of the tension spring 39. The spring force of the tension spring 39 is, therefore, approximately five to ten times larger than this minimum value. When the door handle 17 is actuated incorrectly, for example, as a result of the upwardly directed actuating force F being exerted, damage to the control mechanism 38 is, thus, prevented. At the same time, the comparatively large spring force permits an ergonomically favorable operating feel during a normal opening or closing actuation of the door handle 17 by the operator.

Figure 5:
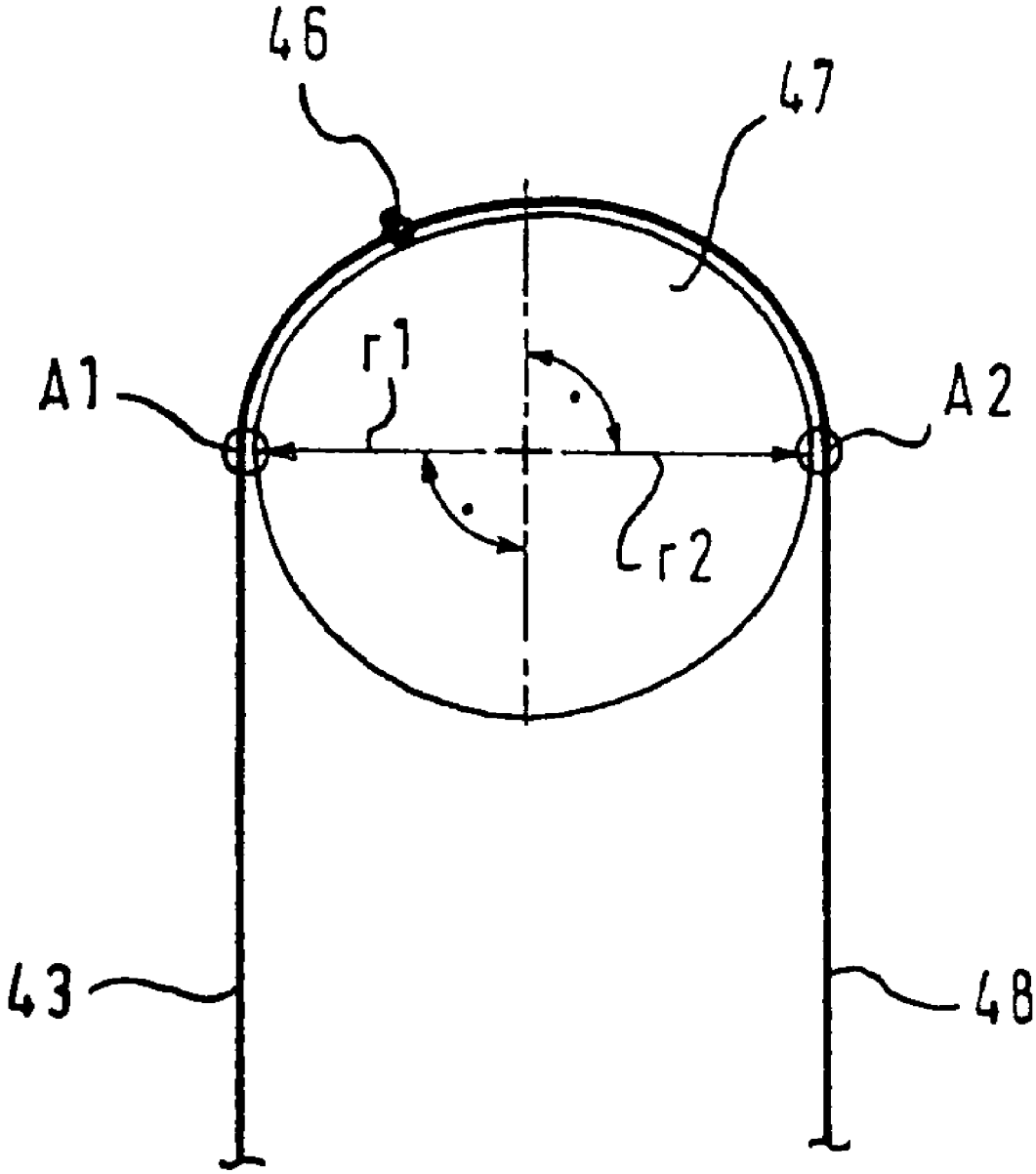
FIG. 5 is a diagrammatic, enlarged, cross-sectional view of a detail of the handle of FIG. 4.

The radius of the cam plate 47 is very important to ensure that the movement of the hinge rod 55 is transmitted to the door handle 17 in a correct transmission ratio. On one hand, the radius of the cam plate 47 determines the length of the lever arm and, thus, the magnitude of the torque by which the pulling cables 43, 48 act on the cam plate 47. On the other hand, the cam-plate radius defines the transmission ratio by which a drive movement of the control mechanism 38 is converted into a pivoting movement of the door handle 17. In FIG. 5, the lever-arm lengths r1, r2 of the cam plate 47, which lengths are associated with the first and the second tension cable 43, 48, are configured such that they differ in magnitude. FIG. 5 shows an enlarged illustration of the radial cam 47 from FIG. 4.

In FIG. 5, the points of action of the pulling cables 43 and 48 are designated A1 and A2. During an operation for opening the door 5, the point of action Al of the pulling cable 43 moves through an angle of rotation of approximately 90° in the counterclockwise direction along the circumference of the cam plate 47. Over this angle of rotation, the lever arm length r1 is substantially constant. The torque M1 exerted on the door handle 17 is, therefore, constant during the pivoting movement of the door 5. At the same time, the engagement point A2 of the tension cable 48 moves through an angle of rotation section of approximately 90° in the counter-clockwise direction along the circumference of the radial cam 47. Over this angle of rotation, the lever arm length r2 is reduced during a pivoting movement of the door 5 from its closed position; that is to say, in the horizontal door position, the torque M2 exerted on the door handle 17 is the lowest possible. In the horizontal door position, the torque M2 counteracts a weight of the door 5; the weight of the door 5 keeps the door 5 stably in its horizontal position. The torque M2, which is reduced in the horizontal door position, is, therefore, not capable of compensating for the weight of the door. The stable position of the door in its horizontal position is, therefore, not adversely affected by the torque M2.

A radial cam 47 that is formed eccentrically enables the transmission ratio of the control mechanism 38 to be changed as a function of the pivoting position of the door 5. It is thus possible to compensate for drive losses of the control mechanism 38, which are produced, for example, at the beginning of a pivoting movement of the door as a result of expansion of the pulling cables 43, 48 or of play in the control mechanism 38.

Figure 6:
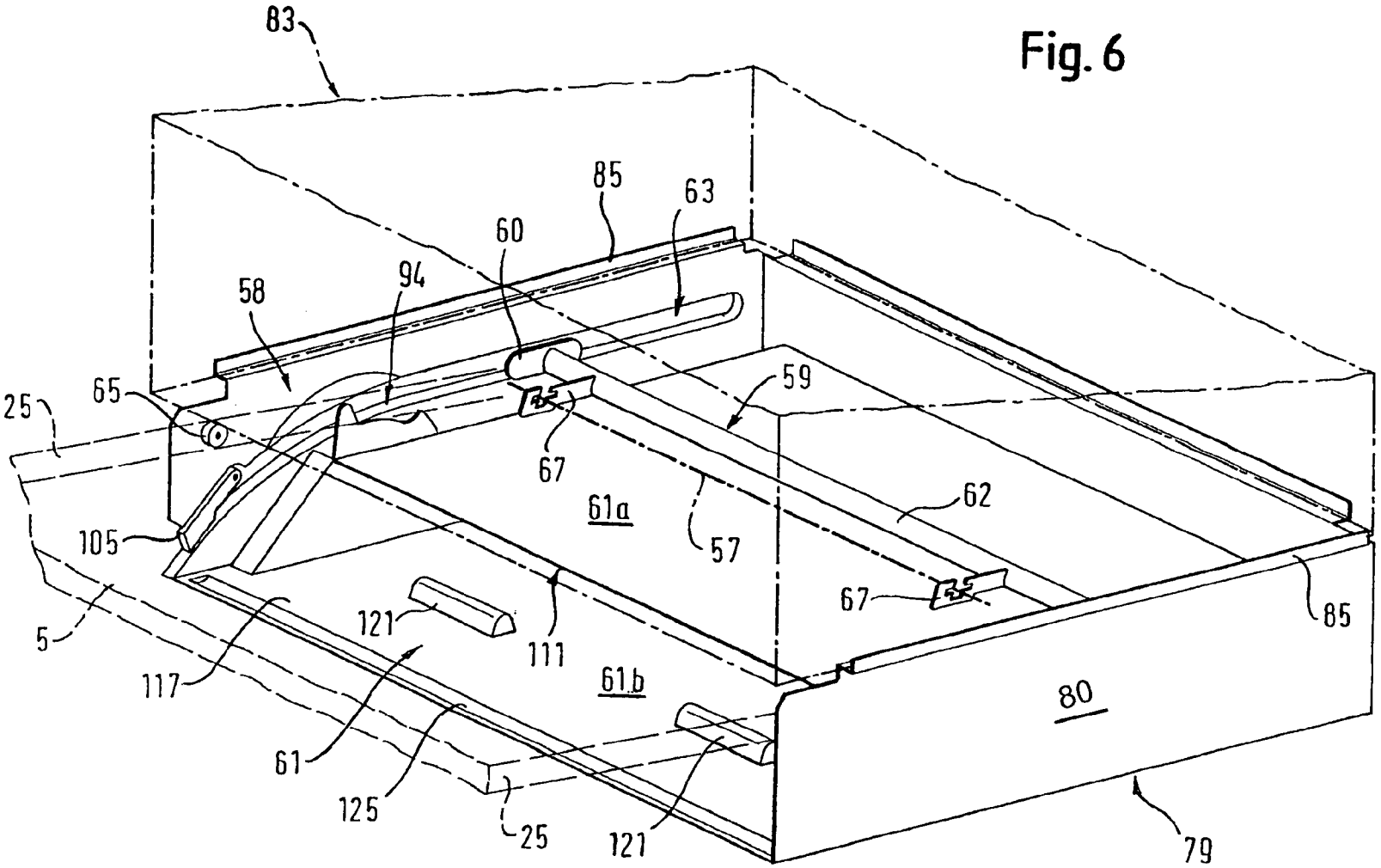
FIG. 6 is a fragmentary, perspective and partially hidden view of a second exemplary embodiment of a cooking appliance according to the invention.

FIG. 6 shows a cooking appliance according to a second exemplary embodiment of the present invention. The cooking appliance has a useful space module 83, which is indicated by a chain-dotted line and in which the cooking appliance muffle 3 is disposed. A storage space module 79 is disposed below the useful space module 83. The storage space module 79 has a storage space 61 in which a guide system 58 for the door 5 is provided. The guide system 58 enables the cooking appliance door 5 (illustrated by dashed lines) to be displaced into the storage space module 79. According to FIG. 6, the storage space module 79 serves as a base or foundation on which the useful space module 83 is mounted. The storage space module 79 is configured as an upwardly open sheet-metal housing. Step-shaped abutment shoulders 85 are formed on the upper edge of the side walls 80 of the sheet-metal housing 79. The useful space module 83 rests on the contact shoulders 85 in a positionally correct manner, as indicated in FIG. 6. The operating and display elements 2, which are shown in FIG. 1, and an associated control unit are provided in the useful space module 83. The operating and display elements 2, here, together with the associated control unit, can function independently of the stowage-space module 79.

The control mechanism 38 of the second exemplary embodiment has, as driving part, a rotary shaft 57 on which the driving drum 54, which is already mentioned in the first exemplary embodiment, is formed. The rotary shaft 57 is operatively connected to a guide element 59 of the guide system 58.

Figure 7:
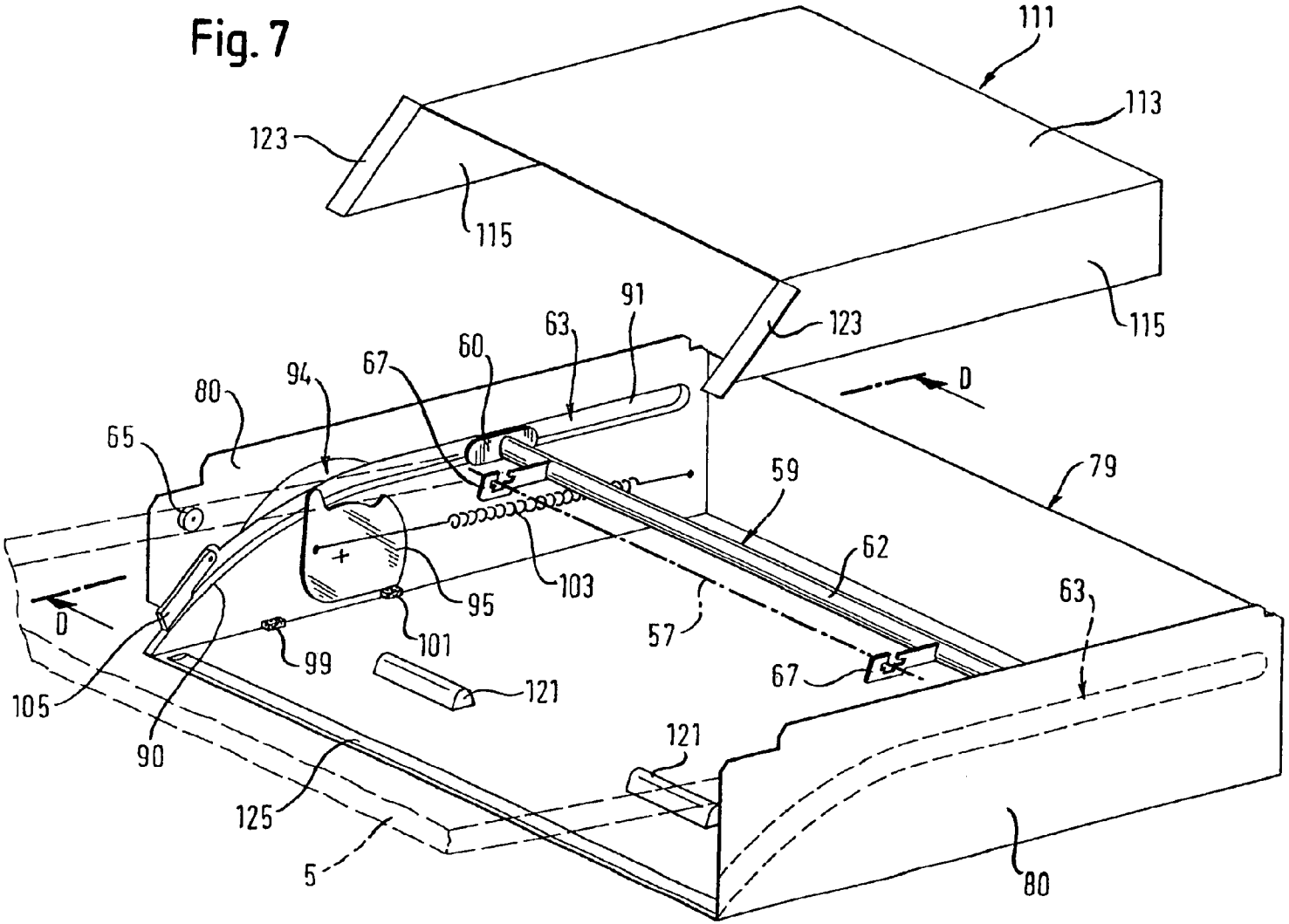
FIG. 7 is a fragmentary, perspective and partially hidden view of a storage space module of the cooking appliance of FIG. 6.

The construction and the functioning of the guide system 58 for the door 5 and the production of a drive movement for the control mechanism 38 is explained hereinbelow:

As illustrated in FIG. 6, the guide element 59 is part of the guide system 58, with the aid of which the door 5 is pushed, during an opening process, into the storage space 61 provided below the cooking space 3. FIGS. 6 and 7 reveal that the guide system 58 has slotted-guide tracks 63. The slotted-guide tracks 63 are formed in the two opposite side walls 80 of the storage space module 79. The opposite slotted-guide tracks 63 guide sliders 60 of the guide element 59 therein. The sliders 60 are welded to each other through a connecting rod 62. The guide element 59 is, therefore, guided in the opposite slotted-guide tracks 63 in the manner of a guide carriage. Between the two sliders 60, adjusting levers 67 are welded to the connecting rod 62. As illustrated in the enlarged perspective cutout of FIG. 8, the adjusting levers 67 are connected in a form-fitting manner to the rotary shaft 57 of the control mechanism 58. The rotary shaft 57 is indicated in FIGS. 6 and 7 by chain-dotted lines.

Figure 8:
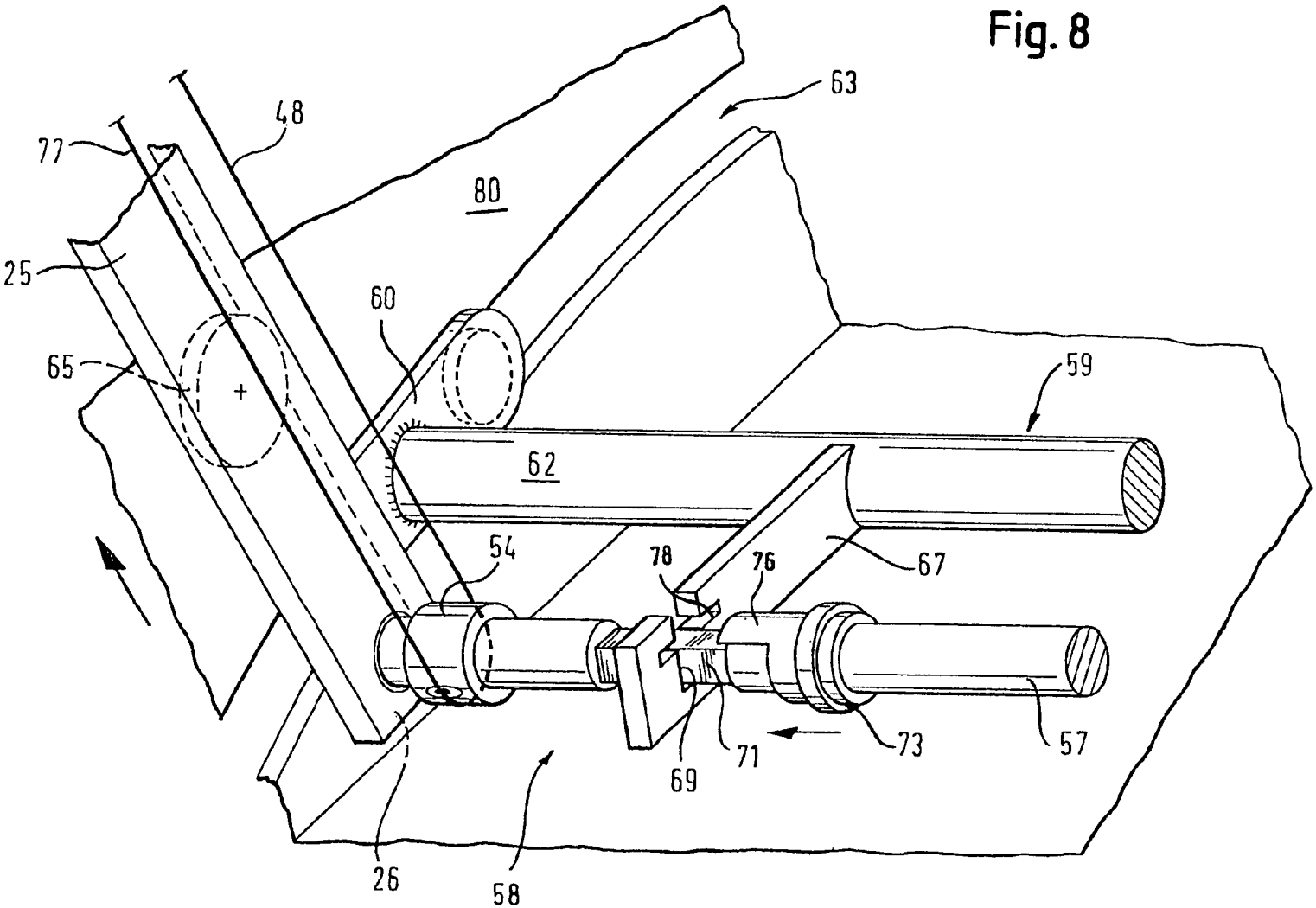
FIG. 8 is a fragmentary, enlarged, perspective view of a detail of the module of FIG. 7.

The above-mentioned form-fitting connection between the adjusting levers 67 of the guide carriage 59 and the rotary shaft 57 of the door 5 is illustrated in FIG. 8. The inner and outer door windows 7, 9 of the door 5 have been omitted from FIG. 8. Accordingly, the rotary shaft 57 is mounted rotatably in the opposite edge strips 25 of the door 5. For the form-fitting connection, the adjusting levers 67 of the guide carriage 59 each have a rectangular cutout 69. A corresponding, rectangular shape section 71 of the rotary shaft 57 is mounted in the cutout 69. The lateral edge strips 25 of the door 5 are provided in the outward direction in each case with a U-shaped groove that serves as a guide rail. In these guide rails 25, respective bearing rollers 65 are guided displaceably on both sides. The bearing rollers 65 are fastened to the side wall 80 of the storage space module 79. The U-shaped groove, which serves as a guide rail, is constructed on its lower end side with an open end 26. When the door is removed, as will be described at a later stage in the text, the housing-mounted bearing roller 65 can be released from the associated guide rail 25 by way of the open end 26.

Each of the opposite slotted-guide tracks 63 has a starting section 90 and a slide-in section 91. According to FIGS. 9A and 9C, an angle of inclination of the starting section 90 is approximately 45°. The starting section 90, furthermore, takes up approximately 30% of the entire length of the slotted-guide track 63 while the transition between the starting section 90 and the slide-in section 91 has a curved profile. The slide-in section 91 runs substantially in a horizontal plane. The bearing rollers 65, which are fixed on the housing, are disposed approximately level with the slide-in section 91 of the slotted-guide track 63.

Figure 9A:
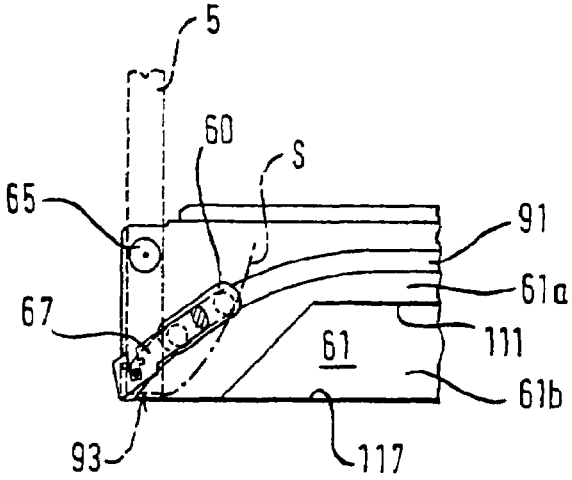
FIG. 9A is a fragmentary, side elevational and partially hidden view of a first part of an opening process of the mechanism of FIG. 8.
Figure 9B:
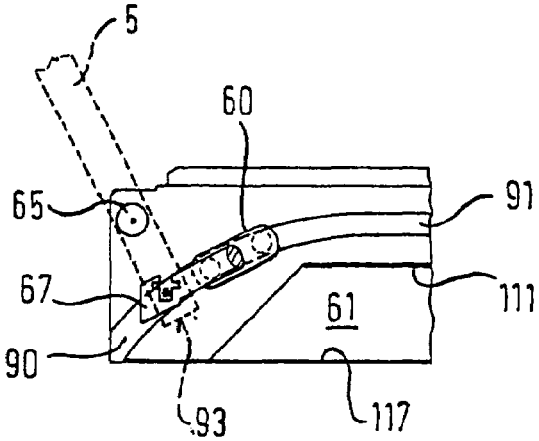
FIG. 9B is a fragmentary, side elevational and partially hidden view of a second part of an opening process of the mechanism of FIG. 8.
Figure 9C:
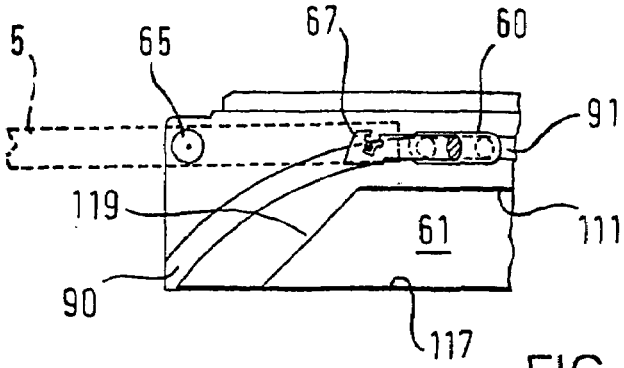
FIG. 9C is a fragmentary, side elevational and partially hidden view of a third part of an opening process of the mechanism of FIG. 8.

The course of movement of the guide carriage 59 of the door 5 in the slotted-guide tracks 63 is described with reference to FIGS. 9A to 9C. FIG. 9A shows the door 5 in its closed position. In the closed position, the sliders 60 of the guide carriage 59 are in the starting section 90 of the slotted-guide track 63. During an opening movement of the door 5 from its closed position shown in FIG. 9A, the sliders 60 of the guide carriage 59 are initially displaced upward. As a result, the adjusting levers 67 of the guide carriage 59 lift the door 5 upward. With this lifting movement of the door 5, a lower end side 93 of the door 5, which side pivots into the storage space 61, is displaced, at the same time, upward away from a base 117 of the storage space module 79, as is revealed in FIG. 9B. As a result, a pivoting region S of the lower end side 93, which region protrudes into the storage space 61 and is indicated by a chain-dotted line, is reduced. After the guide carriage 59 is moved from the starting section 90 into the horizontal slide-in section 91, the door 5 is in a horizontal plane, in which it can be slid into the storage space 61. During the pivoting movement of the door 5, a pivoting angle between the door 5 and the guide block 59 changes. Because the rotary shaft 57 of the control mechanism 38 is mounted in a form-fitting manner in the adjusting levers 67 of the guide slide 59, the change in the pivoting angle between the door 5 and the guide carriage 59 causes a rotation of the rotary shaft 57. That is to say, during the pivoting movement of the door 5, the rotary shaft 57 is inevitably rotated by the guide element 59.

Figure 10:
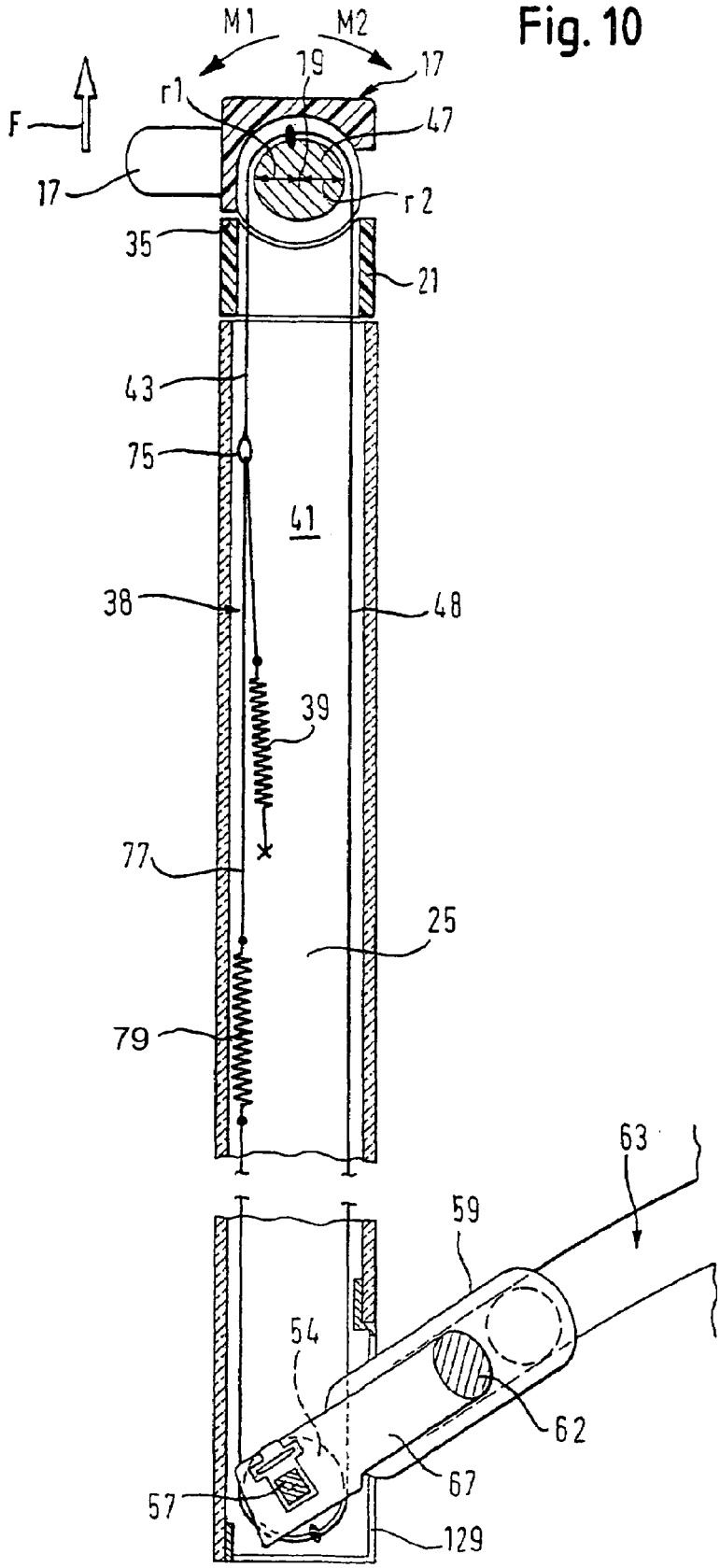
FIG. 10 shows a side sectional illustration of an upper and lower section of a second embodiment of the door of the cooking appliance from FIG. 6.

The manner in which the control mechanism 38 transmits the inevitable rotation of the rotary shaft 57 to the door handle 17 is explained with reference to FIG. 10. FIG. 10 shows a side sectional view of the upper and lower section of the door 5 according to the second exemplary embodiment. This reveals that the adjusting lever 67 protrudes through an access opening 129 of the door 5 into the interior space 41 of the door and is connected in a form-fitting manner to the rotary shaft 57. As can be gathered from FIGS. 8 and 10, the rotary shaft 57 is configured with a driving drum 54, which is disposed in a rotationally fixed manner on the rotary shaft 57. The driving drum 54 is in engagement circumferentially with the tension cable 48. As in the first exemplary embodiment, the tension cable 48 is connected to the door handle 17.

During the pivoting movement of the door 5, a pivoting movement, therefore, arises between the guide carriage 59 and the door 5. As a result, the rotary shaft 57 is rotated inevitably. The rotational movement of the rotary shaft 57 is transmitted through the driving drum 54 to the tension cable 48. The tension cable 48 converts the rotational movement of the rotary shaft 57 into a rotational movement of the radial cam 47 and subjects the door handle to the second torque M2, which is directed counter to the first torque M1, on the door handle 17. The door handle 17, therefore, retains its horizontal alignment regardless of the pivoting position of the door 5.

In contrast to FIG. 4 of the first exemplary embodiment, in FIG. 10, the first tension cables 43, which engage on both sides on the radial cams 47 of the pivoting part 16 of the door handle 17, are not connected to a common tension spring. Rather, according to FIG. 10, each of the first tension cables 43 is associated with a dedicated tension spring 39. The tension spring 39 is fastened at one end of the spring to the edge strip 25 of the door 5. The other end of the tension spring 39 is coupled to the tension cable 43 through a retaining eyelet 75. As a result, the door handle 17 is subjected to the first torque M1 in the counterclockwise direction.

The control mechanism 38 shown in FIG. 10 has a third tension cable 77. The third tension cable 77 is, on one hand, in circumferential engagement with the driving drum 54 of the rotary shaft 57 and is guided about the driving drum 54 in the opposite direction to the second tension cable 48. On the other hand, the third tension cable 77 is connected to the retaining eyelet 75 of the first tension cable 43. The first, second, and third tension cables 43, 48, 77 of the control mechanism 38 form a closed cable control that envelops the radial cam 47 and the driving drum 54 to transmit the rotational movement to the door handle 17.

To tighten the closed cable control 43, 48, 77, a tightening spring 79 is integrated in the third tension cable 77. The tightening spring 79 serves to tighten the closed cable control 43, 48, 77. In addition, the tightening spring 79 increases the torque M1 that is exerted by the tension spring 39 on the door handle 17. Therefore, both the tightening spring 79 and the tension spring 39 are present for exerting the torque M1. It is, therefore, advantageously possible for use to be made of two comparatively small springs that take up only a small amount of space in the limited inner space 41 of the door.

If the operator, for example, during transportation of the cooking appliance 1, exerts an upwardly directed actuating force F on the door handle 17 shown in FIG. 4, the resultant pivoting movement of the pivoting part 16 of the door handle in the clockwise direction is absorbed by the tension spring 39 and by the tightening spring 79. The resultant pivoting movement of the pivoting part 16 is, therefore, not transmitted from the door handle 17 to the control mechanism 38. As a result, damage to the control mechanism 38 is prevented.

The dimensioning of the spring force of the tension springs 39, 79 depend on the minimum value for the spring force, which value is specified in conjunction with FIG. 4.

Furthermore, the tension cables 43, 48, 77 can be provided with adjusting elements for adjusting a tensile stressing. By the adjusting elements, the tension cables provided on both sides of the door sides can be acted upon with an identical tensile stress. As a result, a synchronous operation of the two control mechanisms 38 is achieved.

A weight-balancing configuration 94 for the door 5 of the second exemplary embodiment is described below with reference to FIGS. 7, 11, and 12. During a movement of the door 5, the weight-balancing configuration 94 exerts a balancing force on the door 5, which force acts counter to the weight of the door 5. The weight of the door 5 is, therefore, not absorbed by the operator during a door movement, but, rather, by the weight-balancing configuration 94.

FIG. 7 shows, in a perspective view, the storage space module 79, of which a space divider 111 is illustrated separately. On each of the opposite side walls 80, the weight-balancing configuration 94 has a pivoting lever 95. The pivoting lever 95 is mounted pivotally on the opposite side walls 80 through a lever spindle 97. FIG. 11 shows one of the side walls 80 in an enlarged side elevational view along the line D-D from FIG. 7. Accordingly, the pivoting lever 95 protrudes into the starting section 90 of the slotted-guide track 63 and is in engagement with the slider 60 of the guide carriage 59. A pivoting region of the pivoting lever 95 is configured such that the pivoting lever 95 is in engagement with the slider 60 of the guide carriage 59 only in the region of the starting section 90. By contrast, in the horizontal section 91, the pivoting lever 95 is disengaged from the slider 60 of the guide carriage 59. The pivoting lever 95 is connected to a tension spring 103. The tension spring 103 is fastened to the side wall 80. In FIG. 11, the tension spring 103 pre-stresses the pivoting lever 95 in the counter-clockwise direction.

Figure 11:
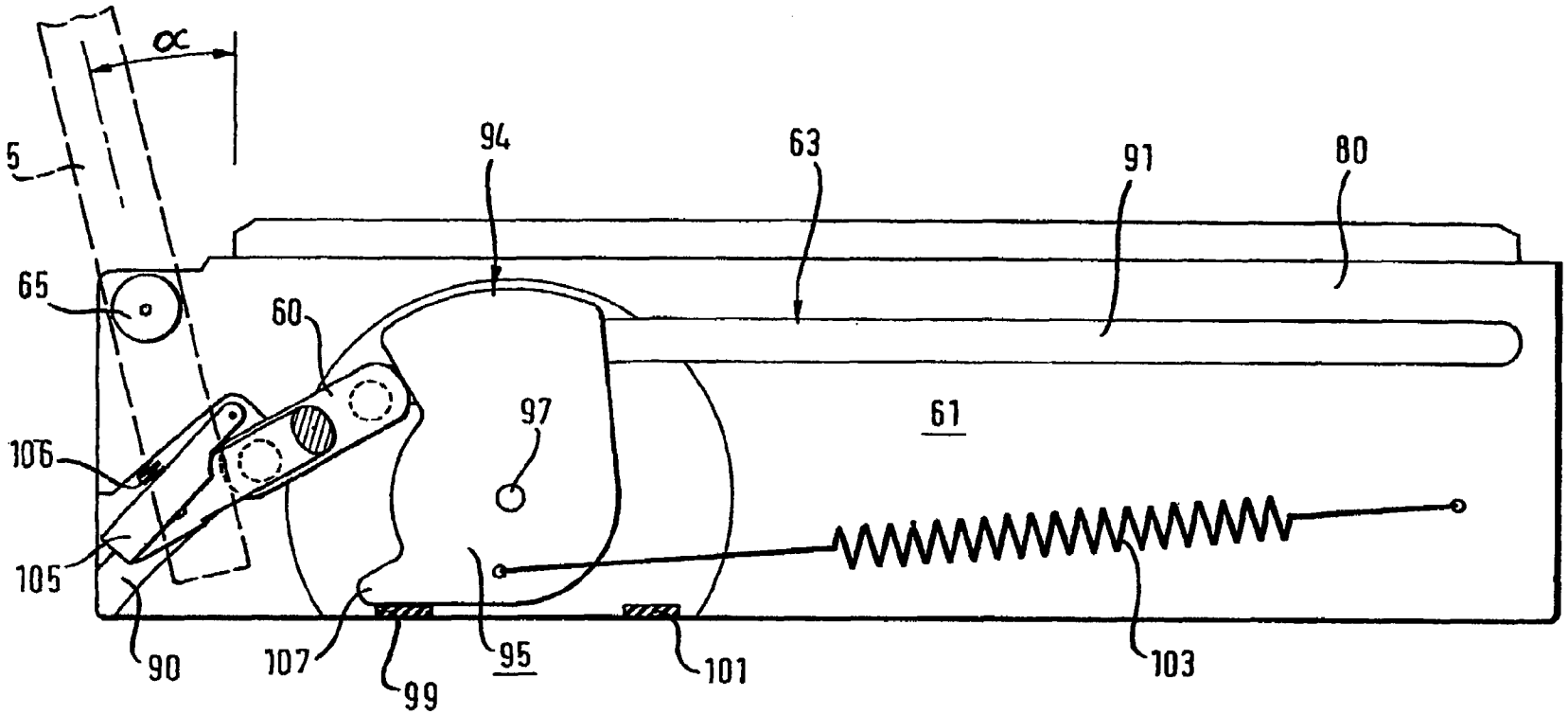
FIG. 11 is a side elevational view of the mechanisms of FIGS. 7 and 8 along line D-D in FIG. 7 in a first position.

When the door 5, which is illustrated by dashed lines in FIG. 11, is pivoted from its closed position downward into the horizontal position, the slider 60 runs from the starting section 90 into the horizontal section 91 of the slotted-guide track 63. During this movement, the slider 60 of the guide slide 59 presses against the spring-pre-stressed pivoting lever 95. The pivoting lever 95, therefore, subjects the sliding component 60 to a balancing force. The balancing force acts counter to the weight of the door 5.

As illustrated in FIG. 11, the pivoting lever 95 is pressed by the spring 103 against a first end stop 99, which is formed by a rubber support. In the position shown in FIG. 11, the pivoting lever 95 permits an initial movement of the slider 60 of the guide carriage 59 out of the closed position of the door 5. During this initial movement, the slider 60 does not engage with the pivoting lever 95. According to FIG. 11, the slider 60 comes into contact with the pivoting lever 95 only at a pivoting angle of the door 5 of approximately 20°. This simplifies the initial movement of the door 5 out of its closed position for the operator. Moreover, the pre-stressed pivoting lever 95 according to FIG. 11 acts as a stop against which the slider 60 of the guide carriage 59 strikes during the opening movement of the door 5. A certain pivoting position of the door 5 is, thus, signaled to the user. In the present case, this pivoting position corresponds to a removal position, in which a simple removal of the door 5 from the guide system 58 is made possible.

Furthermore, the weight-balancing configuration 94 has a pivotally mounted retaining element 105 that is pre-stressed by a spring 106. During the previously described initial movement of the door 5, the spring-pre-stressed retaining element 105 presses the slider 60 of the guide carriage 59 in the direction of the pivoting lever 95. As a result, the door 5 is retained stably in the removal position shown in FIG. 11.

Figure 12:
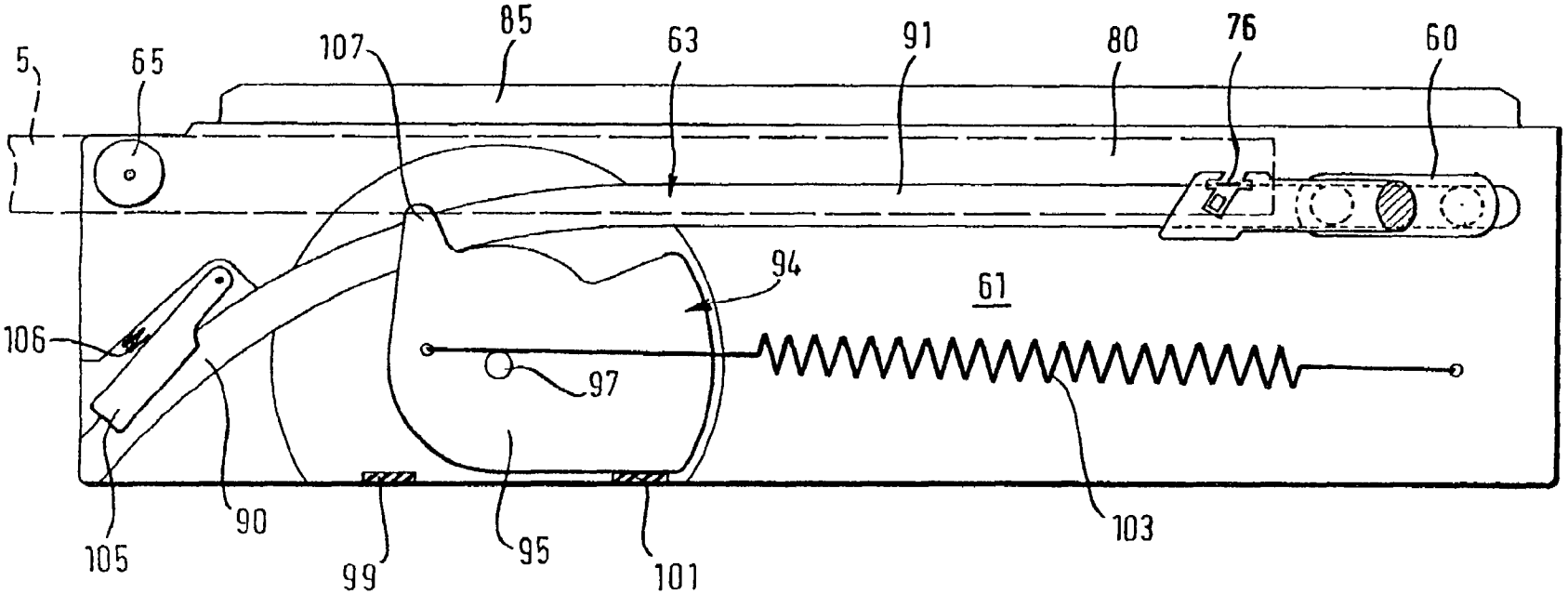
FIG. 12 is a side elevational view of the mechanism of FIG. 11 in a second position.

FIG. 12 shows the door 5 mounted horizontally and slid into the storage space 61. The slider 60 of the guide carriage 59 of the door 5 is in the horizontal slide-in section 91 of the slotted-guide track 63. During the movement of the slider 60 in the region of the slide-in section 91 of the slotted-guide track 63, the pivoting lever 95 is disengaged from the slider 60. The pivoting lever 95, therefore, does not exert any balancing force on the door 5. While the slider 60 runs in the slide-in section 91 of the slotted-guide track 63, the pivoting lever 95 is in the clockwise direction, by the spring 103, against a second end stop 101, which is, likewise, formed by a rubber support.

The pivoting lever 95 has a driver 107. The driver 107 of the pivoting lever 95 protrudes, in FIG. 12, into the slotted-guide track 63. According to FIG. 12, the slider 60 has been displaced from the starting section 90 into the slide-in section 91 of the slotted-guide track 63. The adjusting lever 95 is pre-stressed against the second end stop 101 and is in a holding position. When the door 5 is displaced out of the storage space 61, the slider 60 comes into engagement with the driver 107 of the pivoting lever 95. As a result, the pivoting lever 95 is brought out of its holding position and comes, once again, into a pressure contact with the slider 60 of the guide carriage 59. As a result, the pivoting lever 95 can, once again, exert the balancing force on the guide carriage 59 during a pivoting movement of the door 5.

The releasable mounting of the door 5 on the guide system 58 is explained below with reference to FIG. 8. Due to the releasable mounting of the door 5 in the guide system 58, the door 5 can easily be removed for cleaning. As already described with reference to FIG. 8, the adjusting levers 67 have a rectangular cutout 69. The corresponding rectangular shape section 71 of the rotary shaft 57 is mounted in the rectangular cutout 69. This produces a form-fitting connection between the guide carriage 59 and the rotary shaft 57. A locking element 73 that, according to FIG. 8, is mounted on the rotary shaft 57 is explained below. The locking element 73 can be displaced between a locking position and a release position. In the release position, the locking element 73 releases the mounting of the rotary shaft 57 in the adjusting lever 67. In a locking position of the locking element 73, the rotary shaft 57 is connected non-releasably to the adjusting lever 67.

The space divider 111 that is mentioned in conjunction with FIG. 7 is explained in the following text. As emerges, in particular, from FIG. 6, the space divider 111 is disposed in the storage space module 79. The space divider 111 divides the storage space 61 into a first storage space 61*a* and a second storage space 61*b*. The space divider 111 has a horizontal intermediate base 113 and side walls 115. The door 5 can be displaced into the first storage space 61*a*. The space divider 111 also separates the guide system 58, which is formed from the slotted-guide track 62 and guide carriage 59, and the weight-balancing configuration 94 from the second storage space 61*b*. Baking sheets or other accessories may be stored in the second storage space 61*b*.

As emerges from FIGS. 9A to 9C, the space divider 111 is disposed below the starting section 90 and the slide-in section 91 of the slotted-guide track 63. The intermediate base 113 together with the side walls 115 and a housing base 117 form an access opening 119. The latter is disposed spaced apart from the pivoting region S (indicated by a chain-dotted line) of the lower end side 93 of the door 5. Display elements 121 are provided in the region of the access opening 119 of the second storage space 61*b*. The display elements 121 are configured as cams or protuberances that are fastened to the base 117 of the storage space 61. The display elements 121 indicate to the operator a maximum permissible length for objects that can be stored in the second storage space 61*b* without protruding into the pivoting region S of the lower end side 93 of the door 5. Appliance front-side panels 123 are formed on the side walls 115 of the space divider 111. The panels 123 serve for concealing the first storage space 61*a* from view. In addition, a collecting or drip channel 125 is provided in the housing base 117, in the region of the appliance front-side access opening 119, to keep the second storage space 61*b* free from contaminants, for example, dripping condensation water.

We claim:

1. A household appliance, comprising:

a housing defining a useful space, a door opening, and a storage space;

a horizontal hinge pin connected to said housing;

a slotted-guide track connected to said housing;

a door pivotally mounted about said hinge pin to pivot with respect to said housing and, thereby, selectively close off said door opening and said useful space;

a guide system having at least one guide element connected to said door, said guide system displacing said door into said storage space, said door being pivotable about said hinge pin between a close position in which said door closes off said door opening and a position of said door in a substantially horizontal plane when said slotted-guide track guides said door into said storage space; and at least one weight-balancing configuration operatively connected to said door and, during the initial pivoting of said door about said hinge pin between said close position and said substantially horizontal position of said door, exerting a balancing force on said door with a cessation of said balancing force exerted on said door occurring before said door reaches said substantially horizontal position of said door, said balancing force acting counter to a weight of said door during said initial pivoting of said door about said hinge pin and said door being movable horizontally, during at least the completion of the displacement movement of said door into said storage space, without said balancing force being exerted thereagainst.

2. The household appliance according to claim 1, wherein said weight-balancing configuration is disengaged from said door during a horizontal movement of said door into or out of said storage space.

3. The household appliance according to claim 1, wherein said weight-balancing configuration operatively acts upon said guide element of said door to exert said balancing force.

4. The household appliance according to claim 1, wherein said weight-balancing configuration has a spring exerting a spring force as said balancing force on said door.

5. The household appliance according to claim 4, wherein:

said weight-balancing configuration has a pivoting lever;

said spring interacts with said pivoting lever; and said pivoting lever exerts said spring force on said guide element.

6. The household appliance according to claim 5, wherein:

said slotted-guide track has a starting section guiding said door in a pivoting movement; and said guide element operatively engages said pivoting lever while moving in said starting section.

7. The household appliance according to claim 6, wherein:

said door is disposed substantially vertically in a closed position and pivots away from said closed position into an open position; and said weight-balancing configuration starts engaging said door after said door opens to a given extent in a direction of said open position.

8. The household appliance according to claim 7, wherein said given extent is a pivoting angle of approximately 20° from said closed position.

9. The household appliance according to claim 7, further comprising:

a first end stop at said housing; and said spring presses said pivoting lever against said first end stop when said door is between said closed position and said given extent.

10. The household appliance according to claim 7, wherein:

a distance traveled by said door between said closed position and said given extent defines a pivoting angle region; and said slotted-guide track has a holding element pressing said guide element in a direction of said pivoting lever within said pivoting angle region.

11. The household appliance according to claim 9, wherein:

a distance traveled by said door between said closed position and said given extent defines a pivoting angle region; and said slotted-guide track has a holding element pressing said guide element in a direction of said pivoting lever within said pivoting angle region.

12. The household appliance according to claim 6, wherein:

said slotted-guide track has a slide-in section merging into said starting section; and said door is displaced within a substantially horizontal plane when said slotted-guide track guides said door in said slide-in section.

13. The household appliance according to claim 12, wherein said pivoting lever is disengaged from pressing against said guide element during a movement of said guide element in a region of said slide-in section.

14. The household appliance according to claim 13, further comprising:

a second end stop at said housing; and said spring presses said pivoting lever against said second end stop during movement of said guide element in said region of said slide-in section.

15. The household appliance according to claim 14, wherein said pivoting lever has a driver returning said pivoting lever back into pressing engagement with said guide element during a displacement of said door from said slide-in section into said starting section of said slotted-guide track.

16. The household appliance door according to claim 1, wherein the household appliance door is a cooking appliance door.

17. The household appliance according to claim 1, wherein said slotted-guide track has a starting section guiding said door in a pivoting movement, said weight-balancing configuration includes a balancing force application element for operatively acting upon said guide element of said door to exert said balancing force and a biasing component having one end secured to said housing and an opposite end secured to said balancing force application element, said guide element operatively engaging and moving said balancing force application element while said guide element moves along said starting section of said slotted track section with this movement of said balancing force application element by said guide element effecting extension of said biasing component with a resulting increase of a biasing force applied to said balancing force application element such that said balancing force application element corresponding yieldingly resists movement of said guide element as said guide element moves along said slotted track section, said biasing component extending to reach a maximum extension as said guide element continues moving along said slotted track section and said biasing component retracting from its maximum extension before said guide element completes its movement along said slotted track section.

18. The household appliance according to claim 17, wherein said biasing component is a spring exerting a spring force as said balancing force application element.

19. The household appliance according to claim 18, wherein said balancing force application element is a pivoting lever, said another end of said spring is secured to said pivoting lever and said pivoting lever exerts said spring force on said guide element.

* * * * *